US006840888B1

(12) United States Patent
Winquist et al.

(10) Patent No.: US 6,840,888 B1
(45) Date of Patent: Jan. 11, 2005

(54) HYDRAULIC-ELECTRONIC CONTROL SYSTEMS FOR MARINE VESSELS

(75) Inventors: Timothy Winquist, Sarasota, FL (US); W. R. Terrence Craftchick, Bradenton, FL (US)

(73) Assignee: Teleflex Incorporated

( * ) Notice: Subject to any disclaimer, the term of this patent is extended or adjusted under 35 U.S.C. 154(b) by 0 days.

(21) Appl. No.: 10/219,552

(22) Filed: Aug. 15, 2002

Related U.S. Application Data

(60) Provisional application No. 60/312,914, filed on Aug. 16, 2001.

(51) Int. Cl.[7] ..... B60K 41/04

(52) U.S. Cl. ..... 477/83; 477/86; 477/90; 477/110; 440/86; 440/87

(58) Field of Search ..... 477/77, 83, 84, 477/85, 86, 90, 91, 107, 110; 440/84, 86, 87

(56) References Cited

U.S. PATENT DOCUMENTS 3,613,632 A * 10/1971 Farrell ..... 440/86 X
4,718,869 A * 1/1988 Fisher ..... 440/86 X
4,976,636 A * 12/1990 Torigai et al. ..... 440/87 X
5,002,166 A * 3/1991 Leigh-Monstevens et al. ... 477/83
5,242,320 A * 9/1993 Schmidt et al. ..... 440/86
5,492,493 A * 2/1996 Ohkita ..... 440/86
5,626,534 A * 5/1997 Ashley et al. ..... 477/86 X
6,411,879 B2 * 6/2002 Kupper et al. ..... 477/107 X
6,502,652 B2 * 1/2003 Rogg ..... 180/65.2

FOREIGN PATENT DOCUMENTS

JP 353020295 * 2/1978 ..... 440/86

OTHER PUBLICATIONS

Morse®Controls, "*ETC Remote Electronic Throttle Control, For Engines with Electronic Governors*", "Now there's an electronic throttle control designed specifically for electronically controlled marine engines. The new Morse ETC", 2 pages.

* cited by examiner

*Primary Examiner*—Ha Ho
(74) *Attorney, Agent, or Firm*—Woodcock Washburn LLP

(57) ABSTRACT

Systems and methods for controlling shift and throttle of an electronically controlled power train are disclosed. The system includes a throttle or shift controller having an operating range. An hydraulic slave is in fluid communication with the controller such that a movement of the controller within its operating range causes a flow or displacement of fluid between the controller and the hydraulic slave. The hydraulic slave has a shaft that rotates in response to the fluid flow between the controller and the hydraulic slave. The shaft is adapted to be coupled to a position sensor such that rotation of the shaft causes the position sensor to produce electrical throttle control signals that represent the movement of the controller within its operating range. The electrical signals can be adapted to cause the power train to set an engine throttle and a transmission shift position according to a current position of the controller within its operating range.

20 Claims, 9 Drawing Sheets

HYDRAULIC-ELECTRONIC CONTROL SYSTEMS FOR MARINE VESSELS

CROSS-REFERENCE TO RELATED APPLICATIONS

This application claims priority from Provisional U.S. Patent Application No. 60/312,914, filed Aug. 16, 2001, the contents of which are hereby incorporated herein by reference.

FIELD OF THE INVENTION

This invention relates to control systems for marine vessels. More particularly, the invention relates to shift and throttle control systems for marine vessels that employ hydraulics to control shift and throttle of an electronically controlled engine.

BACKGROUND OF THE INVENTION

Marine vessels frequently employ electronically controlled engines in which throttle and shift are controlled, at least in part, electronically. In such engines, throttle is typically controlled by controlling the output of a potentiometer. Specifically, operation of a throttle control lever, typically located at the bridge, causes rotation of a shaft coupled to a potentiometer so that rotation of the shaft varies the output of the potentiometer. The output of the potentiometer is transmitted to a controller that causes the throttle to vary (i.e., increase or decrease) according to the potentiometer output. Similarly, operation of a shift control lever, which is also typically located at the bridge, causes rotation of a shaft coupled to a potentiometer, the output of which is transmitted to a controller that causes the shift position to vary according to the potentiometer output.

It is well known that operators of such marine vessels like the feel of hydraulic controls. Consequently, marine vessels are frequently equipped with hydraulic controls. The use of hydraulics to control electronically controlled engines via mechanical linkages is well-known and common among large marine vessels. In such systems, operation of a control lever at the bridge sends an hydraulic signal to an hydraulic slave cylinder in the engine compartment. Levers and linkages then convert the motion of the hydraulic slave cylinder's piston into rotation of the potentiometer shaft. Although this approach is workable, it frequently results in lost motion and, therefore, inaccuracies in the throttle control function. Hence, there is a need in the art for improved hydraulic-electronic control systems that convert hydraulic motion into rotational motion for electronic control of shift position and throttle without the need for such levers and linkages.

BRIEF SUMMARY OF THE INVENTION

The invention satisfies the aforementioned needs in the art by providing hydraulic-electronic control systems wherein the throttle position sensor is coupled directly to the hydraulic slave. This eliminates the inefficiencies of the linkages and costly fabrication, and installation of mounting brackets and linkages. An embedded system (e.g., micro-controller) can be used to emulate the signal the engine would receive from the engine manufacturers throttle position sensor. A system according to the invention can also be adapted to include transmission shift and trolling control.

According to the invention, a system for controlling throttle of an electronically controlled engine includes a throttle controller, such as a control lever, for example. The throttle controller has an operating range. An hydraulic slave cylinder is in fluid communication with the throttle controller such that a movement of the controller within its operating range operates the hydraulic slave cylinder. The hydraulic slave cylinder has a shaft that rotates in response to the motion of the hydraulic slave cylinder's piston. The shaft is adapted to be coupled to a throttle position sensor such that rotation of the shaft causes the throttle position sensor to produce electrical throttle control signals that represent the movement of the throttle controller within its operating range. The throttle control signals represent the signals that the engine would receive from its own position sensor and, therefore, cause the engine to adjust its throttle appropriately.

BRIEF DESCRIPTION OF THE SEVERAL VIEWS OF THE DRAWING

Other features of the invention are further apparent from the following detailed description of the embodiments of the present invention taken in conjunction with the accompanying drawing, of which.

DETAILED DESCRIPTION OF THE INVENTION

Figure 1:
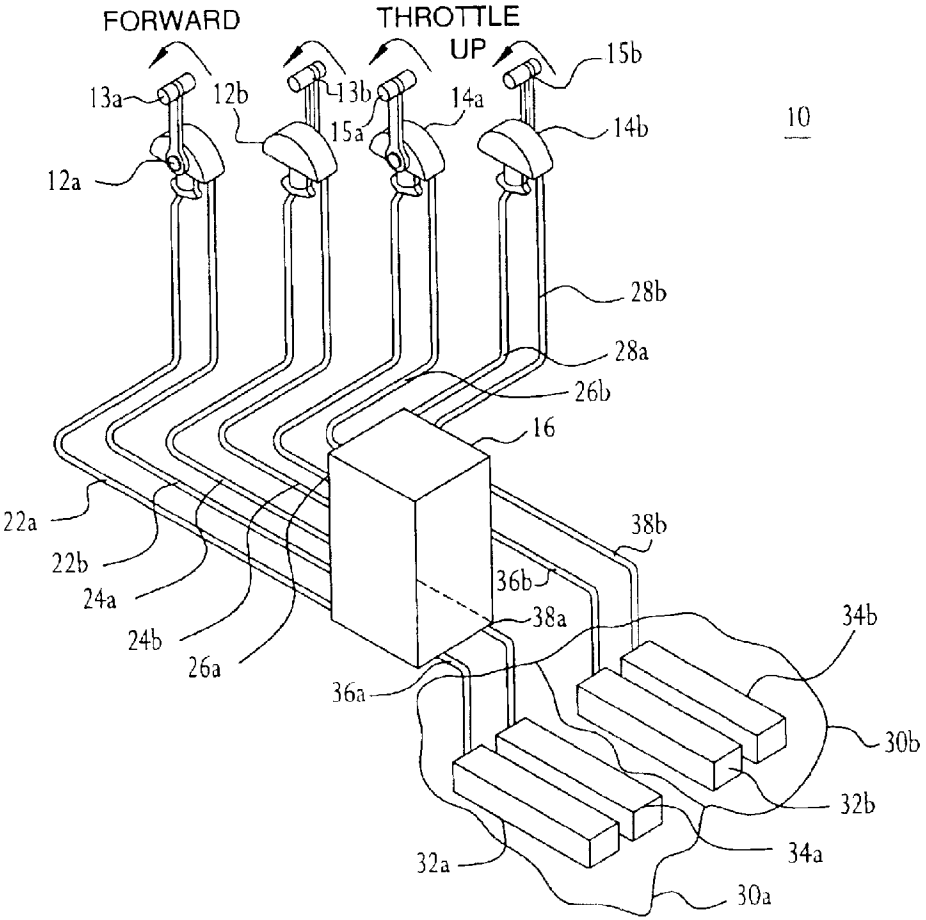
FIG. 1 depicts an electronic control system according to the invention.

FIG. 1 depicts an electronic control system 10 according to the invention. As shown, the control system 10 can include a first (or port) shift control head 12*a,* a second (or starboard) shift control head 12*b,* a first (or port) throttle control head 14*a,* and a second (or starboard) throttle control head 14*b.* Though the control system 10 depicted in FIG. 1 includes four control heads, it should be understood that a control system according to the invention can include any number or type of control heads.

Each control head is hydraulically coupled to one or more hydraulic-electronic control unit (HECUs) 16. Preferably, the control heads are coupled to the HECU 16 by one or more hydraulic feed lines. As shown, hydraulic feed line 22*a* channels hydraulic fluid from the HECU 16 to the port shift control head 12*a.* Hydraulic feed line 22*b* channels hydraulic fluid from the port shift control head 12*a* to the HECU 16. Hydraulic feed line 24*a* channels hydraulic fluid from the HECU 16 to the port shift control head 12*b*. Hydraulic feed line 24*b* channels hydraulic fluid from the port shift control head 12*b* to the HECU 16. Hydraulic feed line 26*a* channels hydraulic fluid from the HECU 16 to the port shift control head 14*a*. Hydraulic feed line 26*b* channels hydraulic fluid from the port shift control head 14*a* to the HECU 16. Hydraulic feed line 28*a* channels hydraulic fluid from the HECU 16 to the port shift control head 14*b*. Hydraulic feed line 28*b* channels hydraulic fluid from the port shift control head 14*b* to the HECU 16.

The HECU 16 is electrically connected to a first (or port) power train 30*a* and to a second (or starboard) power train 30*b*. Power train 30*a* includes a first (or port) transmission 32*a* and a first (or port) engine 34*a*. Power train 30*b* includes a second (or starboard) transmission 32*b* and a second (or starboard) engine 34*b*. The HECU 16 is electrically coupled to the transmission 32*a* of power train 30*a* via an electrical path 36*a*. The HECU 16 is electrically coupled to the engine 34*a* of power train 30*a* via an electrical path 38*a*. The HECU 16 is electrically coupled to the transmission 32*b* of power train 30*b* via an electrical path 36*b*. The HECU 16 is electrically coupled to the throttle 34*b* of power train 30*b* via an electrical path 38*b*.

Port shift control head 12*a* includes a shift controller 13*a*, and starboard shift control head 12*b* includes a shift controller 13*b*. As shown, the shift controllers 13*a* and 13*b* can be levers (or control arms) that are rotationally coupled to the shift control heads 12*a* and 12*b*, respectively. Port throttle control head 14*a* includes a throttle controller 15*a*, and starboard throttle control head 14*b* includes a throttle controller 15*b*. As shown, the throttle controllers 15*a* and 15*b* can be levers (or control arms) that are rotationally coupled to the throttle control heads 14*a* and 14*b*, respectively. It should be understood that movement of a control arm through its operating range affects the current shift/throttle position of the transmission/engine to which the control arm is coupled.

Figure 2:
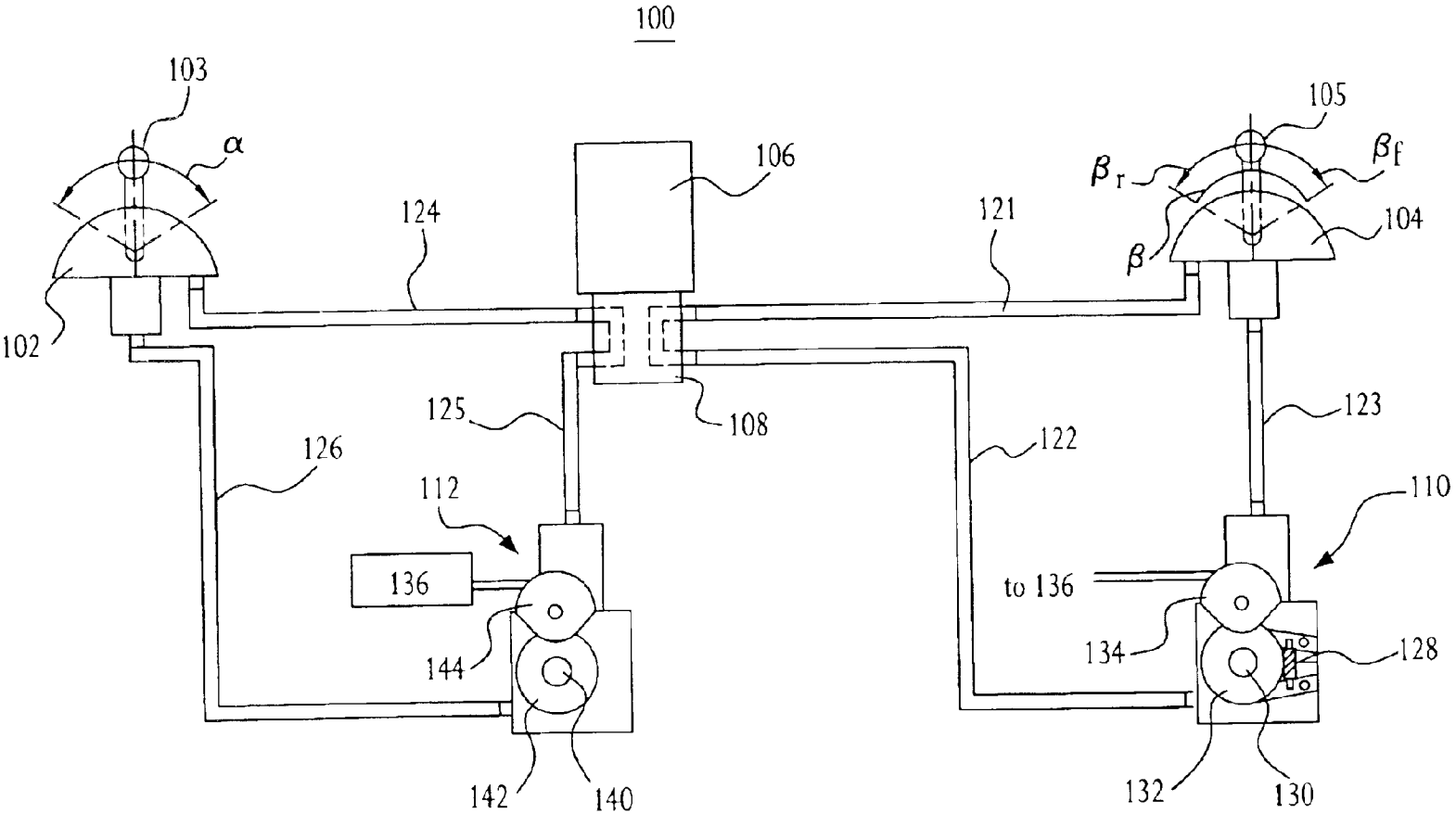
FIG. 2 is a detailed block diagram of an electronic control system according to the invention having single lever, single functionality (SLSF) capability.

FIG. 2 is a detailed block diagram of an electronic control system 100 according to the invention having single lever, single function (SLSF) capability. The control system 100 includes a throttle control head 102 having a throttle controller 103 for controlling the throttle of an associated engine (not shown in FIG. 2), and a shift control head 104 having a shift controller 105 for controlling the shift position of an associated transmission (not shown in FIG. 2). The throttle controller 103 is operable over an operating range $\alpha$; the shift controller 105 is operable over an operating range $\beta$. The operating range $\beta$ of the shift controller 105 includes a forward operating range $\beta_f$ and a reverse operating range $\beta_r$.

An optional reservoir 106 contains hydraulic fluid that it feeds into an optional charging block 108. Preferably, the hydraulic fluid is a 50-50 mix of ethlyene glycol and distilled water, though it should be understood that any appropriate hydraulic fluid can be used.

The shift controller 105 is in fluid communication with the charging block 108 via a hydraulic feed line 121. The charging block 108 is in fluid communication with an hydraulic shift slave 110 via a hydraulic feed line 122. Therefore, the hydraulic shift slave 110 is in fluid communication with the shift controller 105. Movement of the shift controller 105 within its operating range $\beta$ causes a flow or displacement of fluid between the shift control head 104 and the charging block 108, which, in turn, causes a flow or displacement of fluid between the charging block 108 and the shift slave 110. Thus, movement of the shift controller 105 within its operating range $\beta$ causes a flow or displacement of fluid between the shift control head 104 and the shift slave 110. It should be understood that movement of the shift controller 105 can also be made to compress the hydraulic fluid. The shift slave 110 is in fluid communication with the shift control head 104 via a hydraulic feed line 123.

The shift slave 110 has a shaft 130 that rotates in response to the fluid flow between the shift control head 104 and the shift slave 110. The shaft 130 is coupled to a gear 132. The gear 132 is coupled to a shift position sensor 134. Preferably, the shift position sensor 134 is a potentiometer having a gear shaft (not shown) that the gear 132 engages. Rotation of the shaft 130 causes the shift position sensor 134 to rotate and, thereby, causes the shift position sensor 134 to produce electrical shift control signals. Rotational position of the shift position sensor 134 can be related to the position of the shift controller 105 within its operating range $\beta$. Thus, the electrical shift control signals represent the movement of the shift controller 105 within its operating range $\beta$.

The shift position sensor 134 provides the shift control signals to a microprocessor 136, which is electrically coupled to a transmission (not shown). Specifically, the shift position sensor 134 provides the shift control signals to the microprocessor's analog-to-digital (A/D) input. The voltage of the shift control signals varies depending on the position of the shift controller 105 within its operating range $\beta$. Preferably, the shift position sensor 134 is a potentiometer driven by a 5V input voltage. Accordingly, a shift control signal can range between nearly 0V when the shift controller 105 is at one end of its operating range $\beta$, to nearly 5V when the shift controller 105 is at the other end of its operating range $\beta$.

Consequently, the microprocessor 136 can determine the position of the shift controller 105 within its operating range $\beta$ based on the voltage of the shift control signal it receives from the shift position sensor 134. The microprocessor 136 knows a priori where the forward range, neutral range, and reverse range are within the shift controller's operating range $\beta$. Thus, the microprocessor 136 can determine whether the transmission should be in a shift position of forward, neutral, or reverse, and send to a control processor in the transmission a signal that emulates the signal the control processor would receive from the transmission's own shift position sensor. The control processor in the transmission then controls the shift position of the transmission as it is programmed to do. Thus, a hydraulic control system according to the invention can be used to shift an electronically controlled transmission.

The shift slave 110 can also include a detent mechanism 138. The detent mechanism 138 preferably includes a spring between two rotating bars that work in combination to provide the user with a recognizable "feel" when the shift controller 104 has moved into the Neutral position.

The throttle controller 103 is in fluid communication with the charging block 108 via a hydraulic feed line 124. The charging block 108 is in fluid communication with a hydraulic throttle slave 112 via a hydraulic feed line 125. Therefore, the hydraulic throttle slave 112 is in fluid communication with the throttle controller 103. Movement of the throttle controller 102 within its operating range $\alpha$ causes a flow or displacement of fluid between the throttle control head 102 and the charging block 108, which, in turn, causes a flow or displacement of fluid between the charging block 108 and the throttle slave 112. Thus, movement of the throttle controller 103 within its operating range $\alpha$ causes a flow or displacement of fluid between the throttle control head 102 and the throttle slave 112. It should be understood that movement of the throttle controller 103 can also be made to compress the hydraulic fluid. The throttle slave 112 is in fluid communication with the throttle control head 102 via a hydraulic feed line 126.

The throttle slave 112 has a shaft 140 that rotates in response to the fluid flow between the throttle control head 102 and the throttle slave 112. The shaft 140 is coupled to a gear 142. The gear 142 is coupled to a throttle position sensor 144. Preferably, the throttle position sensor 144 is a potentiometer having a gear shaft (not shown) that the gear 142 engages. Rotation of the shaft 140 causes the throttle position sensor 144 to rotate and, thereby, causes the throttle position sensor to produce electrical throttle control signals. Rotational position of the throttle position sensor 144 can be related to the position of the throttle controller 103 within its operating range $\alpha$. Thus, the electrical throttle control signals represent the movement of the throttle controller 103 within its operating range $\alpha$.

The throttle position sensor 144 provides the throttle control signals to the microprocessor 136, which is electrically coupled to the engine (not shown). Specifically, the throttle position sensor 144 provides the throttle control signals to the microprocessor's analog-to-digital (A/D) input. The voltage of the throttle control signals varies depending on the position of the throttle controller 103 within its operating range $\alpha$. Preferably, the throttle position sensor 144 is a potentiometer driven by a 5V input voltage. Accordingly, a throttle control signal can range between nearly 0V when the throttle controller 103 is at one end of its operating range $\alpha$, to nearly 5V when the throttle controller 103 is at the other end of its operating range $\alpha$.

Consequently, the microprocessor 136 can determine the position of the throttle controller 103 within its operating range $\alpha$ based on the voltage of the throttle control signal it receives from the throttle position sensor 144. The microprocessor 136 knows a priori what engine throttle corresponds to what position of the throttle controller 103 within its operating range $\alpha$. For example, in a preferred embodiment, a 12-bit Digital-to-Analog Converter (DAC) can be used to supply the engine with a voltage representing the desired throttle position. A 12-bit DAC provides 4096 increments from no throttle to full throttle. Preferably, the throttle control lever 103 has an operating range $\alpha$=115°. Thus, there can be 4096/115≈36 increments per degree of movement of the control lever 103 (thereby providing "fluid" adjustment of the throttle). The microprocessor 136 provides the DAC with a digital signal that represents the desired output voltage. The DAC converts the digital signal to an analog voltage to emulate the signal the engine would receive from its own throttle potentiometer. Thus, the microprocessor 136 can determine where the engine throttle should be set, and send to a control processor in the engine a signal that emulates the signal the control processor would receive from the engine's own throttle position sensor. Thus, a hydraulic control system according to the invention can be used to throttle an electronically controlled engine.

As shown in FIG. 2, the hydraulic slave cylinders 110, 112, position sensors 134, 144, and microprocessor 136 can be located proximate the control heads 102, 104, which are typically installed at the bridge or helm, rather than proximate the power trains, which are typically installed remote from the bridges, in an engine room below deck, for example. Electrical signals can be sent from the microprocessor 136 to the power trains, without the need for levers and linkages as were previously required for communication between the slave and the position sensor.

Figure 3:
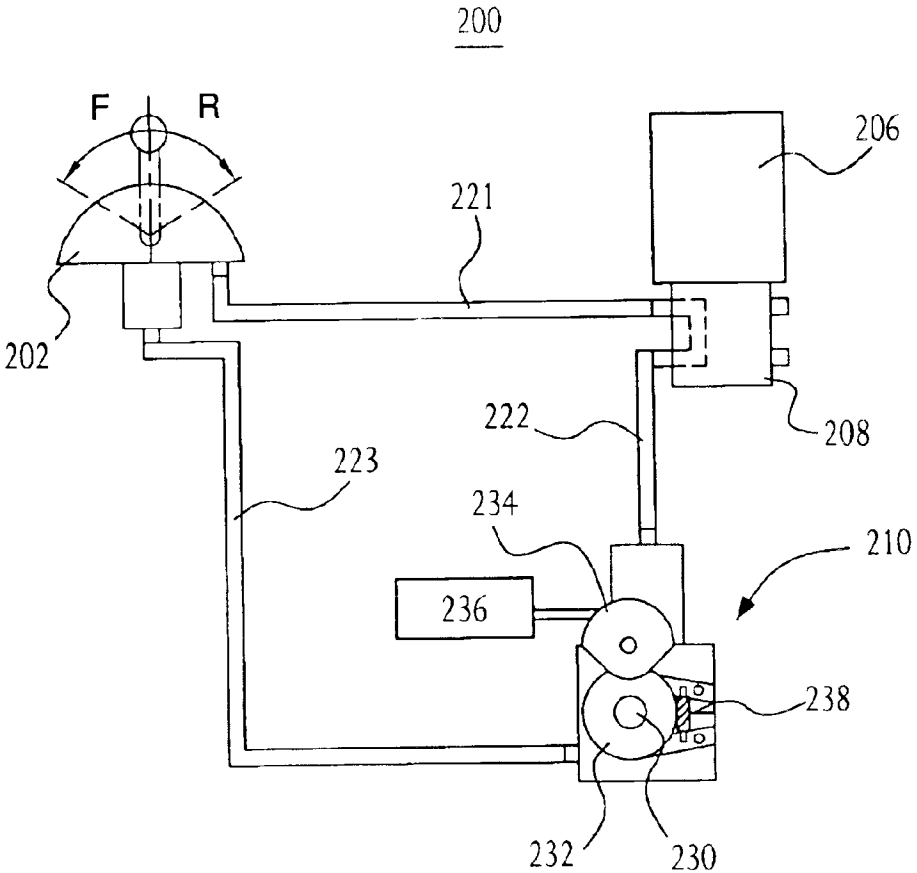
FIG. 3 is a detailed block diagram of an electronic control system according to the invention having single lever, dual functionality (SLDF) capability.

FIG. 3 is a detailed block diagram of an electronic control system 200 according to the invention having single lever, dual function (SLDF) capability. That is, the control system 200 includes a dual function controller 202 for controlling both shift position of an associated transmission (not shown) and throttle position of an associated engine (not shown).

An optional reservoir 206 contains hydraulic fluid that it feeds into an optional charging block 208. The hydraulic fluid can be, for example, a 50-50 mix of ethlyene glycol and distilled water, though any appropriate hydraulic fluid can be used. The dual function controller 202 is in fluid communication with the charging block 208 via a hydraulic feed line 221. The charging block 208 is in fluid communication with a dual function slave 210 via a hydraulic feed line 222. The dual function slave 210 has a shaft 230. The shaft 230 is coupled to a gear 232. The gear 232 is coupled to a position sensor 234. Preferably, the position sensor 234 has a gear shaft (not shown) that the gear 232 engages. The position sensor 234 outputs an electrical signal to a microprocessor 236. The microprocessor 236 is electrically coupled to both the engine throttle and transmission (not shown). The dual function slave 210 is in fluid communication with the dual function controller 202 via a hydraulic feed line 223. The dual function slave 210 can also include a detent mechanism 238. The detent mechanism 238 preferably includes a spring between two rotating bars that work in combination to provide the user with a recognizable "feel" when the shift controller 202 has moved into the Neutral position.

Figure 4A:
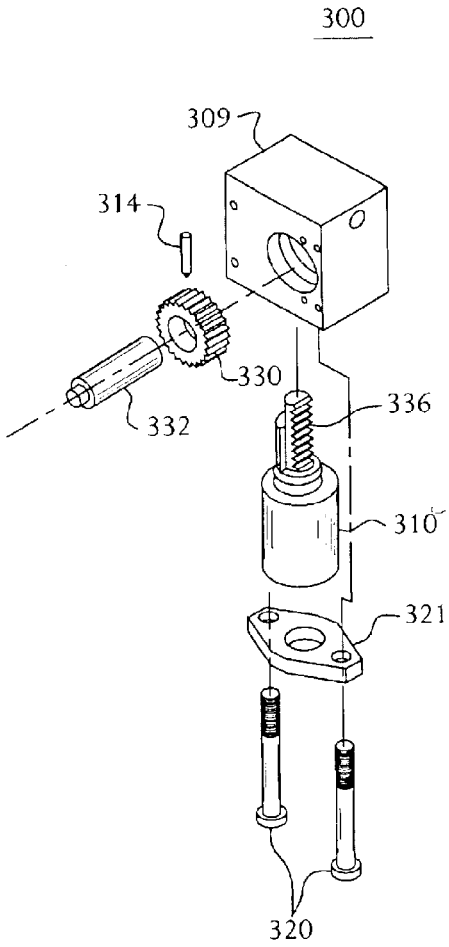
FIG. 4A is an exploded view of a preferred embodiment of an hydraulic slave according to the invention.

FIG. 4A is an exploded view of a preferred embodiment of an hydraulic slave 300 according to the invention. The hydraulic slave 300 depicted in FIG. 4A can be used for any of the hydraulic slaves 110, 112, 210 described above in connection with FIGS. 2 and 3.

The hydraulic slave 300 includes a body 309, a cylinder assembly 310, a plate 321 and a pair of bolts 320 that secure the cylinder assembly 310 and the plate 321 to the body 309. The body 309 contains a pinion assembly 308. The pinion assembly includes a pinion gear 330, with lock 334, and a shaft 332. The cylinder assembly 310 has a rack end 336 that is adapted to engage the pinion gear 330.

Figure 4B:
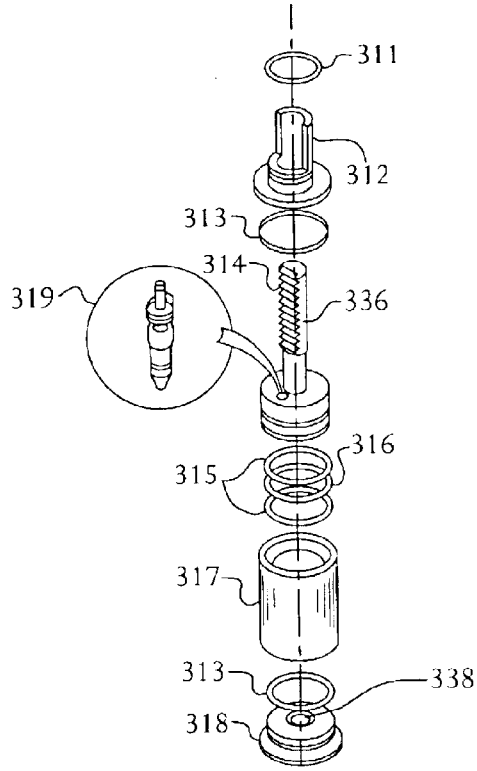
FIG. 4B is an exploded view of a cylinder assembly according to the invention.

FIG. 4B is an exploded view of a cylinder assembly 310 according to the invention. The cylinder assembly 310 includes a cylinder end 318 having a fluid port 338. An hydraulic feed line (not shown) can be coupled to the cylinder end 318 such that hydraulic fluid can flow into and out of the cylinder assembly 310 via the fluid port 338. The cylinder assembly also includes a cylinder tube 317, and a pair of O-rings 313, 316 that prevent fluid from leaking out of the cylinder tube 317. The cylinder assembly 310 also includes a pair of Teflon back-up rings.

The cylinder assembly 310 also includes a piston assembly 314. The piston assembly 314 has a rack end 336 that is adapted to engage the pinion gear 330. The piston assembly 314 can include a bleeder valve 319 for allowing excess air to escape the cylinder. The cylinder assembly 310 includes an eccentric end 312, which is adapted to permit the rack end 336 of the piston assembly 314 to extend out of the cylinder assembly 310 and engage the pinion gear 330. The cylinder assembly 310 also includes O-rings 311 and 313 that prevent fluid from leaking out of the cylinder tube 317. The cylinder tube 317 contains the piston assembly 314. As hydraulic fluid flows into and out of the cylinder assembly 310 via the fluid port 338, the piston assembly 314 moves linearly. The rack end 336 of the piston assembly 314 causes the pinion gear 330 to rotate. Rotation of the pinion gear 330 causes a corresponding rotational motion of the shaft 332.

Figure 5A:
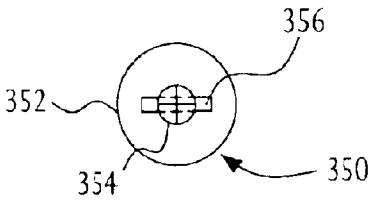
FIGS. 5A–5C depict a shaft adapter for use with a system according to the invention.
Figure 5B:
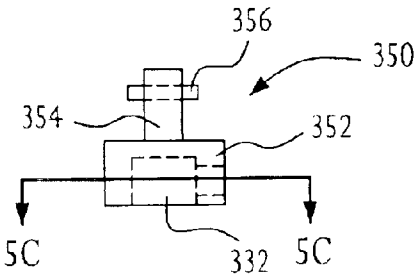
Figure 5C:
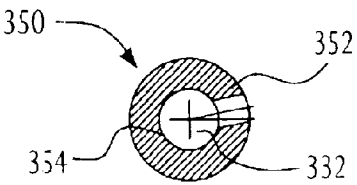

FIGS. 5A–5C depict a shaft adapter 350 for use with a system according to the invention for coupling the shaft 332 to the position sensor. The shaft adapter 350 can be designed to couple any shaft with any position sensor. A shaft adapter 350 is desirable because the rotational position of the shaft as a function of the position of the controller within its range can be fixed (and known) for all systems, regardless of the rotational requirements of the particular position sensor. The shaft adapter 350 has a shaft end 352 that is adapted to receive the shaft 352, and a sensor end 354 that is adapted to be received by the position sensor. As shown, the sensor end 354 of the shaft adapter 350 can also include a cross-bar 356 for attaching the position sensor to the shaft adapter 350.

Figure 6:
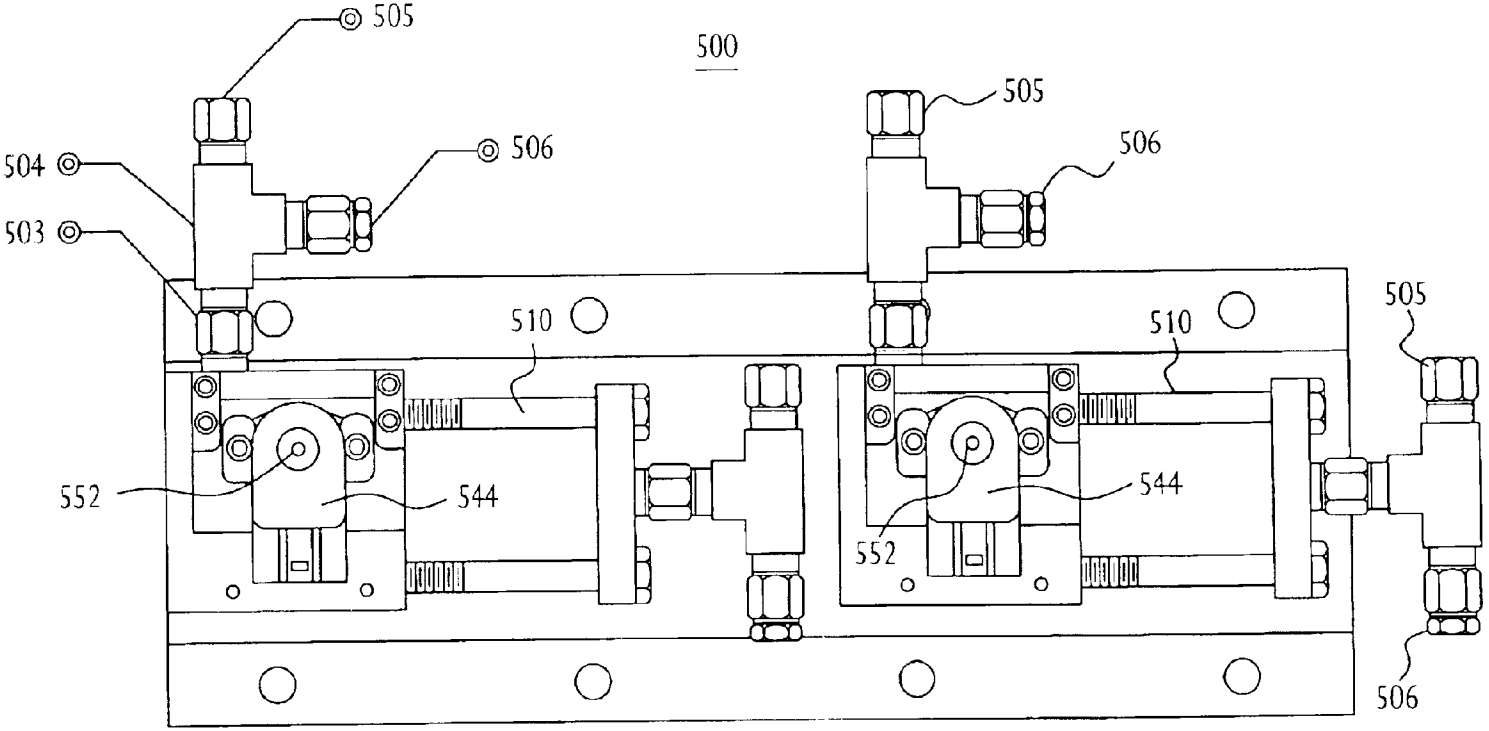
FIG. 6 depicts an alternate embodiment of an electronic control system according to the invention.

FIG. 6 depicts an alternate embodiment of an electronic control system 500 according to the invention wherein the shaft 552 is coupled directly to the position sensor 544, rather than via a gear (such as described above). In such an embodiment, the shaft 552 can be coupled to a position sensor 544 that is provided by the engine/transmission manufacturer. Accordingly, the electrical signals out of the position sensor 544 can be sent directly to the engine/transmission, rather than through the system's microprocessor. Two such slaves are shown in FIG. 6. Thus, a system according to the invention can be applied to any number of engines/transmissions.

The system 500 includes two hydraulic slaves 510. Each hydraulic slave 510 can include the features described above in connection with FIG. 4. Each slave has a shaft 552 that is coupled directly to a position sensor 544. As hydraulic fluid passes through one of the slaves 510, the respective piston (not shown) moves in a linear fashion, thereby causing the respective shaft 552 to rotate. The rotational motion in the shaft 552 causes the respective position sensor 544 to rotate. The rotational motion of the position sensor 544 affects the voltage of the output electrical signal, which is transmitted to the engine/transmission. The engine/transmission determines the current position of the throttle/shift controller within its operating range based on the current voltage of the electrical signal. The engine/transmission throttles/shifts based on the current position of the throttle/shift controller within its operating range.

As shown, the system 500 can also include hydraulic inputs 505 for receiving hydraulic fluid into the slave 510, and bleeder assemblies 506 for allowing excess air to escape. The hydraulic inputs are coupled to the slaves via pipes 504 and pipe nipples 503.

Figure 7:
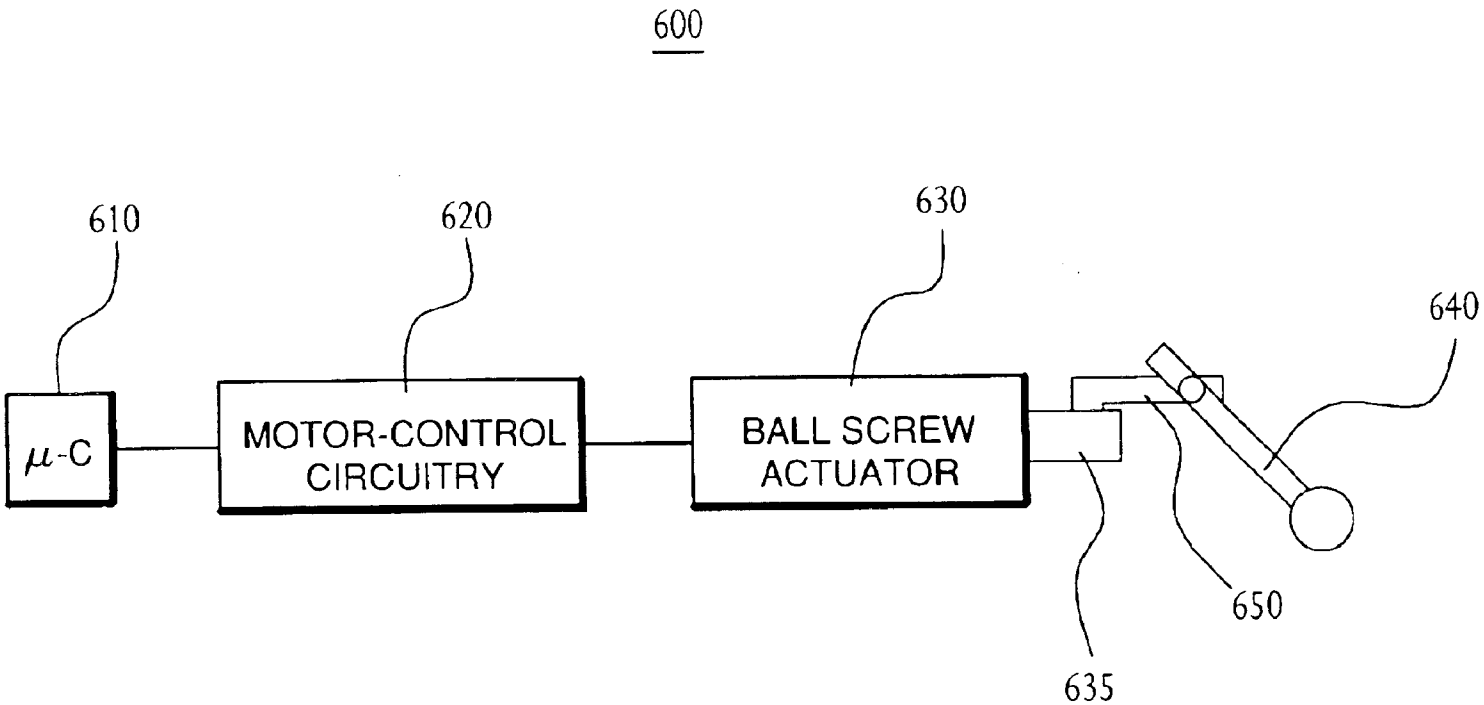
FIG. 7 is a block diagram of a trolling valve actuation system.

FIG. 7 is a block diagram of a trolling valve actuation system 600. It is well known that many engines use mechanical trolling valves. Consequently, a preferred embodiment of a system according to the invention preferably includes an optional trolling valve actuation system 600 as shown. The trolling valve actuation system 600 can include a microprocessor 610, motor-control circuitry 620, and an actuator 630. The microprocessor 610 determines whether trolling has been engaged (via an algorithm described below). If trolling has been engaged, the microprocessor 610 causes the actuator 630 to actuate the trolling valve lever arm 640. The actuator 630 is preferably a ball screw actuator that includes a ball shaft 635 and a motor (not shown). Control signals from the microprocessor 610 trigger the motor-control circuitry 620 to operate the actuator motor. The actuator motor drives the ball shaft 635, which is coupled to the trolling valve lever arm 640 via the appropriate linkage 650.

To engage trolling in an SLDF system, the control lever (at the control head) is moved into the 90° Neutral position and a "Troll Engage" button is pressed. Pressing the "Troll Engage" button sends an electrical pulse to the microprocessor 610. Thus, the microprocessor 610 can detect that the "Troll Engage" button has been pressed. The control lever can then be moved to either the Full Forward or Full Reverse position. Troll will not engage until the microprocessor 610 detects that the control lever has been moved to either the Full Forward or Full Reverse position. Preferably, a "Troll Engaged" indicator light at the control head will illuminate when troll is engaged.

To disengage troll in an SLDF system, the control lever is moved into the 90° Neutral position, and a "Troll Disengage" button is pressed. The control lever is then moved to either Full Forward or Full Reverse position. The lever is then returned to the 90° Neutral position. Preferably, troll is not disengaged unless the above steps are executed properly. The "Troll Engaged" indicator light will turn off when troll is disengaged.

To engage troll in an SLSF system, the shift lever is moved to the 90° Neutral position and the "Troll Engage" button is pressed. The throttle lever is moved to the Full Forward position. Troll will not engage until the throttle lever is moved to the Full Forward position. Full Throttle is "No Slip" (idle speed), and No Throttle is "Max Slip" (no speed). The shift lever can be used to enter any desired gear while Troll is engaged.

To disengage troll in an SLSF system, the shift lever is moved to the 90° Neutral position and the "Troll Disengage" button is pressed. The throttle lever is moved to the "Full Throttle" position. The throttle lever is then returned to the "No Throttle" position. Troll will not be disengaged unless the above steps are executed properly. The "Troll Engaged" indicator light will turn off when troll is disengaged.

Figure 8:
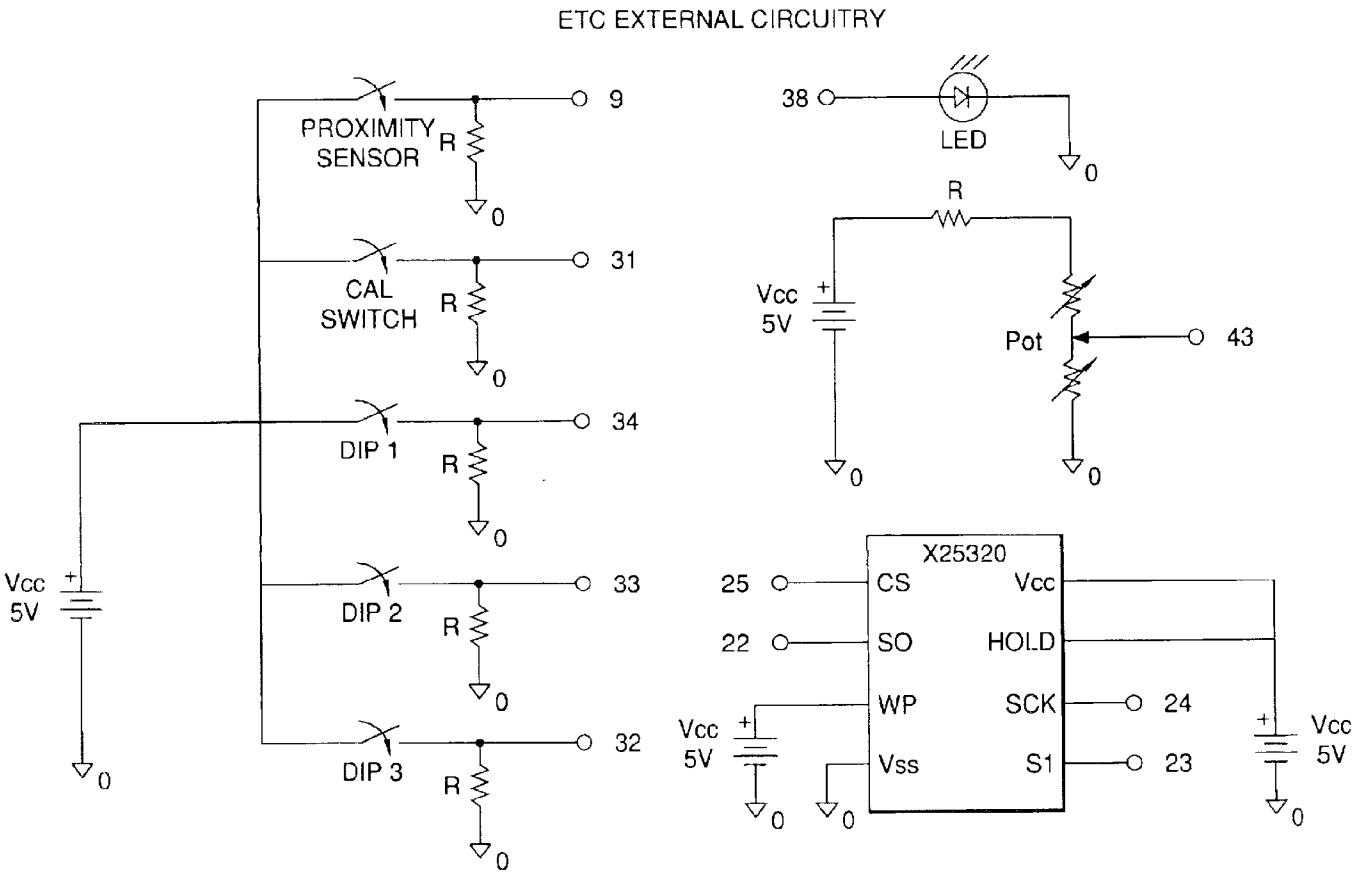
FIG. 8 is a schematic of an exemplary external circuitry for an electronic throttle control system according to the invention.

FIG. 8 is a schematic of an exemplary external circuitry for an electronic throttle control system according to the invention. The signal from the proximity sensor is used as a reference position of the stepping motor. Upon system reset, the stepping motor is stepped up/down until the proximity sensor is activated. Thus, the position of the motor is known upon reset and all future positions of the motor are known.

The calibration switch is actually a push-button and is used to calibrate the system. When this button is pressed, the system knows to perform the calibration routine.

DIP 1, DIP 2, and DIP 3 are DIP switches used to provide the manufacturer code to the micro-controller. The switches provide a 3-bit code. With this configuration, it is possible to control 8 distinct potentiometers.

The LED is used to show when there is a calibration error, and also when the system is in calibration mode.

The ETC potentiometer is used to provide the micro-controller with the throttle position. The voltage across the potentiometer is input to the A/D converter of the micro-controller, and is used to calculate throttle position.

The X25320 is a Xicor serial EEPROM. Though an X25320 EEPROM is depicted, it should be understood that any equivalent EEPROM could be used. The micro-controller communicates with the EEPROM upon system reset to get the stored calibration values. In the calibration routine, the micro-controller writes these values to the external EEPROM for future use.

Figure 9:
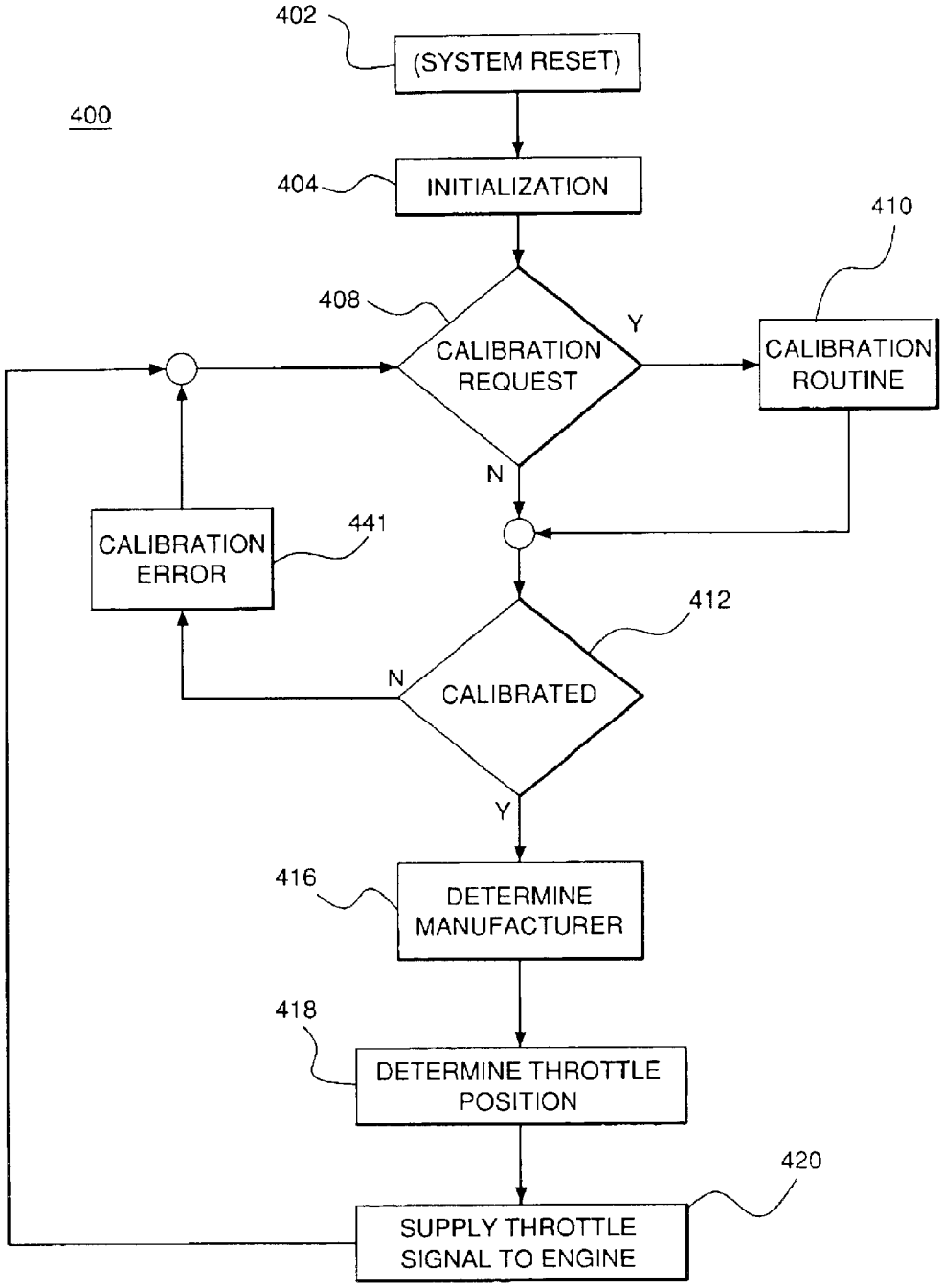
FIG. 9 is a flowchart of a program for controlling a system according to the invention.

FIG. 9 is a flowchart of a method 400 for initializing and calibrating a throttle control system according to the invention. On system reset, at step 402, the analog-to-digital (A/D) system, SPI system, and variables are all initialized at step 404. The SPI system is used to interface the external EEPROM.

At step 408, a determination is made as to whether a calibration request has been made. A calibration request can be made, for example, by a user's pressing a calibration button at the control head. If, at step 408, it is determined that a calibration request has been made, a calibration routine is performed at step 410. In a preferred embodiment, the calibration routine includes the following steps. First, the user releases the calibration button. Then, the user moves the throttle to "no throttle" and presses the calibration button. In response, an LED at the control head will blink off for 0.5s, and then back on. The user then moves the throttle to "full throttle" and presses the calibration button. The LED will blink off for 0.5s, and then back on. The user then returns the throttle to "no throttle" and presses the calibration button. The LED will turn off. At this point, the system is calibrated and the values are stored to the external EEPROM.

At step 412, a determination is made as to whether the system has been calibrated. A determination is made that the system has not been calibrated and, therefore, that a calibration error condition exists, if there are no values stored in the EEPROM. If, at step 412, it is determined that a calibration error exists, then, at step 414, the LED is turned on and the system will return to step 408 to wait for the user to initiate the calibration routine. Preferably, the user cannot adjust the throttle until the system is calibrated.

If, at step 412, it is determined that the system has been calibrated, the 3-bit manufacturer code is read from the DIP switches at step 416. This code is used to calculate radial travel of a stepping motor and direction that the stepping motor is to be turned for throttle up/down.

At step 418, an A/D register is read to retrieve a digital representation of the voltage across the throttle position sensor (e.g., the electronic throttle control's potentiometer). This value is used to determine the current position of the throttle controller. The value of the current position of the throttle controller at any point is the current voltage divided by the voltage range of the throttle. This value is then multiplied by a conversion factor corresponding to the manufacturer code.

At step 420, the engine is supplied with a voltage by the 12-bit DAC that corresponds with the current position of the throttle controller within its operating range. The throttle position sensor is set to a position that corresponds with the current position of the throttle controller within its operating range. Depending on the embodiment of the system, and the engine manufacturer, the throttle position sensor can be set in different ways. For example, in one embodiment the throttle could be at zero, and the throttle position sensor set to produce a small, though non-zero, voltage, which represents zero throttle for that manufacturer.

There will be a dwell built into the system with software. The dwell is 28° of the sender unit. More specifically, the dwell is 14° from neutral to forward and 14° from neutral to reverse. At Neutral, the small cylinder goes to detent and the throttle and shifting functions will not respond until out of detent. This is to decrease the chance of accidental shifting.

Preferably, the ECS provides additional safety features not economically feasible with strictly mechanical systems. For example, it is possible to guarantee that specific steps have to be executed before changing states of the system. Preferably, the system is designed so that it is impossible to deactivate trolling when the clutch is being slipped. Throttle functions can be completely disabled while in troll mode.

Fast Idle/Neutral Lockout (SLDF only): With the ECS, the single lever can be used for fast idle. When the Neutral Lockout button is pressed, the shift function of the lever is disabled, and the lever is used to control throttle only. To deactivate Neutral Lockout, the lever has to be returned to the neutral position before the shift function is activated.

To engage Warm Up/Fast Idle/Neutral Lockout (SLDF only), move the lever to the 90° Neutral position. Press the "Neutral Lockout" button. When Neutral Lockout is engaged, Forward Throttle and Reverse Throttle can be used to rev the engine. The transmission will stay in Neutral until Neutral Lockout is disengaged. The "Neutral Lockout" indicator light will illuminate when Neutral Lockout is engaged.

To disengage Neutral Lockout, return the lever to the 90° Neutral position. Press the "Neutral Lockout" button. The "Neutral Lockout" indicator light will turn off when Neutral Lockout is disengaged.

Thus, there have been described hydraulic-electronic control systems for marine vessels. Those skilled in the art will appreciate that numerous changes and modifications can be made to the preferred embodiments of the invention, and that such changes and modifications can be made without departing from the spirit of the invention. It is intended, therefore, that the appended claims cover all such equivalent variations as fall within the true spirit and scope of the invention.

What is claimed is:

1. A system for controlling shift and throttle of an electronically controlled power train, the system comprising:

a hydraulic control head having a controller operable over an operating range;

a hydraulic slave in fluid communication with the controller such that a movement of the controller within its operating range causes fluid to flow between the hydraulic control head and the hydraulic slave, the hydraulic slave having a shaft that rotates in response to the fluid flow between the hydraulic control head and the hydraulic slave; and a position sensor that is coupled to the shaft such that rotation of the shaft causes the position sensor to produce electrical control signals that represent the movement of the controller within its operating range.

2. The system of claim 1, wherein the electrical control signals are adapted to cause the power train to set an engine throttle and a transmission shift position based on a current position of the controller within its operating range.

3. The system of claim 1, wherein the electrical control signals are adapted to cause the power train to vary at least one of an engine throttle and a transmission shift position based on a the movement of the controller within its operating range.

4. The system of claim 1, wherein the operating range of the controller includes a forward operating range and a reverse operating range.

5. The system of claim 1, wherein the operating range of the controller includes a plurality of discrete throttle positions, and each of the plurality of discrete throttle positions corresponds to a respective engine throttle position.

6. The system of claim 1, further comprising:

a processor that is electrically coupled to the power train, wherein the processor receives the electrical control signals from the position sensor, provides electrical transmission control signals that are adapted to cause a transmission to shift into a shift position that corresponds to a current position of the controller within its operating range.

7. The system of claim 1, further comprising:

a processor that is electrically coupled to the power train, wherein the processor receives the electrical control signals from the position sensor, provides electrical throttle control signals that are adapted to cause an engine to set a throttle that corresponds to a current position of the controller within its operating range.

8. A system for controlling throttle of an electronically controlled engine, the system comprising:

a hydraulic control head having a throttle controller operable over an operating range;

a hydraulic slave in fluid communication with the throttle controller such that a movement of the throttle controller within its operating range causes fluid to flow between the hydraulic control head and the hydraulic slave, the hydraulic slave having a shaft that rotates in response to the fluid flow between the hydraulic control head and the hydraulic slave; and a position sensor that is coupled to the shaft such that rotation of the shaft causes the position sensor to produce electrical throttle control signals that represent the movement of the throttle controller within its operating range.

9. The system of claim 8, wherein the throttle control signals are adapted to cause the throttle of the engine to vary according to the movement of the throttle controller within its operating range.

10. The system of claim 8, wherein the position sensor comprises a potentiometer.

11. The system of claim 8, further comprising:

a second hydraulic control head having a shift controller operable over an operating range;

a second hydraulic slave in fluid communication with the shift controller such that a movement of the shift controller within its operating range causes fluid to flow between the second hydraulic control head and the second hydraulic slave, the second hydraulic slave having a shaft that rotates in response to the fluid flow between the second hydraulic control head and the second hydraulic slave; and a shift position sensor that is coupled to the shaft of the second hydraulic slave such that rotation of the shaft of the second hydraulic slave causes the shift position sensor to produce electrical shift control signals that represent the movement of the shift controller within its operating range.

12. The system of claim 8, wherein the position sensor is coupled directly to the shaft.

13. The system of claim 8, wherein the position sensor is coupled to the shaft via a gear.

14. A system for controlling shift position of an electronic transmission, the system comprising:

a hydraulic control head having a shift controller operable over an operating range;

a hydraulic slave in fluid communication with the shift controller such that a movement of the shift controller within its operating range causes fluid to flow between the hydraulic control head and the hydraulic slave, the hydraulic slave having a shaft that rotates in response to the fluid flow between the hydraulic control head and the hydraulic slave; and a position sensor that is coupled to the shaft such that rotation of the shaft causes the position sensor to produce electrical shift control signals that represent the movement of the shift controller within its operating range.

15. The system of claim 14, wherein the shift control signals are adapted to cause the shift position of the transmission to vary according to the movement of the shift controller within its operating range.

16. The system of claim 14, wherein the position sensor comprises a potentiometer.

17. The system of claim 14, wherein the position sensor is coupled directly to the shaft.

18. The system of claim 14, wherein the position sensor is coupled to the shaft via a gear.

19. The system of claim 14, further comprising: a detent mechanism that provides a user-recognizable feel when the shift controller is moved into a neutral position.

20. The system of claim 19, wherein the detent mechanism includes a spring between two rotating bars that work in combination to provide the user-recognizable feel.

* * * * *